US007228804B2

(12) United States Patent
Stojc et al.

(10) Patent No.: US 7,228,804 B2
(45) Date of Patent: Jun. 12, 2007

(54) DOOR SYSTEM FOR TRANSIT VEHICLE UTILIZING COMPRESSION LOCK ARRANGEMENT

(75) Inventors: Andre Stojc, L'ile Bizard (CA); Simon Evans, Hilton (GB)

(73) Assignee: WABTEC Holding Corp., Wilmerding, PA (US)

( * ) Notice: Subject to any disclaimer, the term of this patent is extended or adjusted under 35 U.S.C. 154(b) by 0 days.

(21) Appl. No.: 10/828,731

(22) Filed: Apr. 21, 2004

(65) Prior Publication Data

US 2005/0235866 A1 Oct. 27, 2005

(51) Int. Cl.
*B61D 3/00* (2006.01)

(52) U.S. Cl. ..... 105/286

(58) Field of Classification Search ..... 105/280, 105/282.1, 282.2, 286, 288, 343; 70/275, 70/276

See application file for complete search history.

(56) References Cited

U.S. PATENT DOCUMENTS 4,901,474 A 2/1990 Bayard et al.
4,981,084 A * 1/1991 Templeton et al. ..... 105/341
5,148,631 A 9/1992 Bayard et al.
5,341,598 A 8/1994 Reddy
6,032,416 A * 3/2000 Springer et al. ..... 49/119
6,125,768 A * 10/2000 Kurnik ..... 105/343
6,189,265 B1 * 2/2001 Fink ..... 49/118
2002/0152684 A1 10/2002 Finke

FOREIGN PATENT DOCUMENTS

CA 2 363 040 8/1998
EP 0846 830 A3 9/1997

* cited by examiner

*Primary Examiner*—S. Joseph Morano
*Assistant Examiner*—Robert J. McCarry, Jr.
(74) *Attorney, Agent, or Firm*—James Ray & Assoc.

(57) ABSTRACT

A locking arrangement for a door system of a transit vehicle includes a combination of a lock mechanism and an electromagnetic brake. The lock mechanism enables positive locking of at least one door but does not require substantial contact between moving and stationary lock elements. The lock mechanism is connected with the manual release means for door opening during an emergency. The electromagnetic brake maintains door seal compression in the closed and locked condition which improves sealing capabilities and provides for reliable lock mechanism operation. Such combination provides locking redundancy and meets various requirements regarding annunciation and manual release operation.

18 Claims, 4 Drawing Sheets

DOOR SYSTEM FOR TRANSIT VEHICLE UTILIZING COMPRESSION LOCK ARRANGEMENT

FIELD OF THE INVENTION

The present invention relates, in general, to a door system for transit vehicles and, more particularly, the instant invention relates to transit vehicle door systems employing locking arrangements for locking one or two doors in either a pushback or non-pushback mode.

BACKGROUND OF THE INVENTION

The following background information is provided to assist the reader to understand the environment in which the invention will typically be used. The terms used herein are not intended to be limited to any particular narrow interpretation unless specifically stated otherwise in this document.

Powered door systems have been extensively utilized in various vehicle applications. Specifically, it is well known in the transit vehicle art to employ a door system having a powered door drive means and a lock mechanism for locking at least one door connected to such powered door drive means and driven thereby to at least partially cover and uncover a door portal aperture in the transit vehicle. Door systems, generally used, are of a sliding, pocket sliding, swing, or swing/sliding combination type. Lock mechanisms employed are generally either of a powered type, employing a solenoid or a cylinder as a lock/unlock mover, or of an over center type depending on the specific requirements. During locking movement, a first locking member mounted on the door or on its carrying member engages a second locking member stationaryly disposed within such lock mechanism, to be restrained from movement while the door is in the substantially closed and locked position and, more importantly, prevent such door from movement in the opening direction. Such lock mechanisms are taught, for example, in U.S. Pat. No. 6,139,073; U.S. Pat. No. 5,927,015; and U.S. Pat. No. 5,280,754; all owned by the assignee of the present invention. The teachings of U.S. Pat. No. 6,139,073; U.S. Pat. No. 5,927,015; and U.S. Pat. No. 5,280,754 are incorporated herein by reference thereto.

An alternative configuration of the lock mechanism allows the door to be closed and locked in, what is well known, a pushback mode. In the pushback mode, a second locking member disposed within the lock mechanism is adapted with a second locked position and a third locked position. The second and third locked positions are spaced apart by a predetermined distance. The door is considered at least partially closed, in terms that it cannot be manually opened to its full open position, when the first locking member passes such third locked position.

However, the door is enabled to be manually moved in the opening direction between the second and third locked position to enable the riding patron to withdraw an object or a garment trapped between mating door edges. This manual movement does not require an action by a drive element disposed within powered door drive means and generally does not provide a signal to the control system of the transit vehicle. After a predetermined time interval the door is commanded to substantially close and lock, at which point the first locking member passes the second locked position preventing any substantial door movement. Such lock mechanisms are taught in U.S. Pat. No. 6,282,970 and U.S. Pat. No. 6,032,416 owned by the assignee of the present invention. The teachings of U.S. Pat. No. 6,282,970 and U.S. Pat. No. 6,032,416 are incorporated herein by reference thereto.

Alternatively, the lock mechanism design may allow the door to be continually in the pushback mode during the transit vehicle movement in which case, the door is allowed to be manually moved in the opening direction until the first locking member reaches the third locked position. A well-known means of achieving continuous pushback is to incorporate a mechanical spring disposed either within the lock mechanism or between the drive nut and the door.

However, the significant disadvantage of the spring pushback is unrestricted and undesirable incremental longitudinal movement of the door during transit vehicle motion, particularly, as the spring fatigues over time. This undesirable movement compromises the sealing capabilities of the door system.

It is of utmost importance to maintain sufficient sealing engagement between adjacent doors disposed within door portal opening or between a single door and the mating edge member of the door portal opening. It is well known that rubber elements, otherwise known as sealing means, which are attached to the mating leading edges of each door, or a door and door portal edge provide the best sealing protection from outside environmental factors, such as moisture, noise and dust, penetrating the interior of the moving transit vehicle. Generally, surfaces of such mating rubber edge elements are in close proximity to each other to minimize the gap between rubber edge elements and, on many installations, such surfaces are in substantial contact with each other. Additional compression of the rubber edge elements is employed to maintain such contact and further to prevent vibration of the door system due to component and assembly tolerances and mechanical wear as the door system ages.

The difficulties of such an arrangement lie in that the lock mechanism must overcome additional frictional forces during locking and unlocking sequences. Tolerances of the rubber edge elements, general door system tolerances and environmental factors affect the engagement between such rubber edge elements resulting in either a frequent need for lock mechanism adjustments and fine tuning, decreased sealing capabilities, or decreased reliability of the lock mechanism operation.

As it can be seen from the above discussion, there is a need to enable sufficient sealing capabilities of the mating rubber edge elements while at least one door is in the closed and locked position without compromising the operation of the lock mechanism.

For passenger safety reasons, some Transit Authorities mandate that during transit vehicle motion the door cannot be manually opened upon actuation of the interior emergency release until the transit vehicle reaches a predetermined speed, typically under 3 miles per hour, generally referred to as zero speed.

The resulting zero speed signal which is produced by a speed sensor within the propulsion system of such transit vehicle is transmitted to the door system via the specially designated trainlines of such transit vehicles. Such mandate is best met with the lock mechanisms of the powered type due to presence of the powered unlock mover and its interface with such trainlines of the transit vehicle enabling positive locking of the first locking member. Yet, the door must be opened regardless of the speed if the exterior emergency release is actuated so that emergency personnel can ingress the vehicle from outside in case of emergency.

Further, as a general requirement related to passenger safety, the door system of the transit vehicle must contain redundancy within the locking arrangement so as to prevent unintentional door opening due to a single point failure within such locking arrangement. Furthermore, it is preferred, that such single point failure must be detectable by the control system of the transit vehicle.

Therefore, there is a need to provide a locking arrangement that meets operational safety requirements and enables sufficient sealing capabilities of the door system.

The U.S. Pat. No. 6,189,285, One- Or Two-Leaf Sliding Door, Swinging Door or Pocket Door, discloses a door system wherein the locking of the door is achieved without the use of the over center or solenoid type lock mechanisms. As illustrated in FIG. 5, the locking arrangement consists of a complex clutch (24-28) or brake in combination with a freewheel (23) which is mounted on the spindle (12) disposed within a powered door drive. The freewheel (23) is disposed at the first end of the spindle (12) and connected to a clutch or a brake via a receptacle (22). The freewheel, essentially, enables rotation of the spindle (12) in the closing direction without disengagement with the clutch (24-28). The clutch (24-28) controls rotation of the spindle (12) in the opening direction.

A drive element (10) enabling spindle (12) rotation and, more importantly enabling door (1, 2) movement, is disposed at the distal end of the spindle (12). The special arrangement of the freewheel (23) and brake results in a final closing position region in which the door (1, 2) is secured against unwanted opening instead of the fixed final closing position determined by the over center or solenoid type lock mechanisms. This results in a substantial simplification in assembly because, for example, there is no longer any need to allow for rubber seals of varying width to achieve required sealing against environmental factors.

The receptacle (22), when held in a stationary condition with respect to spindle (12) rotation, enables rotation of the spindle (12) in the closing direction. In order to open the doors (1, 2), the receptacle (22) must be released and enabled to rotate with the spindle (12). This is achieved by electrical release of the clutch (24-28) enabling the release of the disk (25) from engagement with counter disks (27, 28) which are disposed within the clutch and further enabling rotation of the shaft (24) and the receptacle (22) which is integral with shaft (24) with respect to the rotation of the spindle (12) in the opening direction.

In the emergency condition, manual opening of the door (1, 2) is enabled via a Bowden cable (15) attached to the rod (14) at one end and attached to the manual release handle at the distal end. Actuation of the cable (15) displaces rod (14) enabling release of the clutch (24-28) via a swiveling cam (not shown) so that disk (25) connected to shaft (24) is likewise released.

There are several disadvantages to the prior art design disclosed in U.S. Pat. No. 6,189,285. In the first aspect, the prior art design requires the use of the freewheel (23) and receptacle (22), in addition to clutch (24-28) and brake, as essential elements, to achieve locking and unlocking of the door (1, 2). Such components increase the complexity and cost of the door system and reduce its reliability.

In a second aspect, failure of the clutch mechanism, or failure of the freewheel (23), or failure of the receptacle (22), which are all single point failures, may create a hazardous condition wherein the spindle (12) unintentionally rotates in the opening direction and, more importantly, the door (1, 2) opens unintentionally during transit vehicle movement due to normal vibration, vehicle deceleration and acceleration or the patron leaning against the door (1, 2) thus enabling its movement in the opening direction.

The disclosure does not teach means for detecting and annunciating such failures. Additionally, the adaptation of the roller (18) and a stop surface (17) provides locking redundancy only in the case of a swinging or swinging/sliding combination door type and not in the case of the sliding type, particularly, of the pocket configuration, as those skilled in the art will appreciate that such roller (18) will be disposed within the path of the sliding door (1, 2), thereby preventing its full movement. Adaptation of the prior art design to enable roller (18) to disengage from the door (1, 2) prior to opening movement will result in a presence of the mechanical lock mechanism (or a dead-center mechanism) that the prior art claims to have eliminated. Therefore, the prior art design does not provide locking redundancy in preventing unintentional opening of the door (1, 2) of the sliding or sliding pocket type.

In a third aspect, the described locking arrangement does not provide for combination of locking the door (1, 2) in the pushback mode and enabling claimed sealing advantages due to presence of the freewheel (23) and receptacle (22). A spring loaded link arrangement may be fitted between the drive nut (21) and the door (1, 2) enabling pushback thereof. However, as was aforementioned, such spring loaded link arrangement will negate the adaptation of the clutch (24-28), or brake, to achieve desirable sealing by enabling incremental longitudinal movement of the door (1, 2) which is independent from the action of the clutch (24-28).

As it can be seen from the above discussion, there is a further need to enable sufficient sealing capabilities while at least one door is in the closed and locked position without compromising the safety of the door system operation and providing for a pushback operation.

SUMMARY OF THE INVENTION

The present invention teaches a door system, particularly for a transit vehicle, having at least one door with a sealing means disposed at leading edge thereof. A door drive means is disposed within the transit vehicle for moving the door in an opening and a closing direction. A brake is attached to either an output shaft of the prime mover or the drive spindle for preventing rotation of the drive spindle, thus maintaining the door in a substantially closed and locked position and for maintaining a compression of the sealing means. The door drive means includes a drive spindle, a prime mover having an output shaft attached to one end of the drive spindle with a coupling means, a drive nut collared around the drive spindle, a drive guide member disposed substantially parallel to the drive spindle and at least one hanger bracket attached to the door and connected to the drive nut for enabling its substantially linear movement upon rotation of such drive spindle in the closing and the opening direction, and further enabling movement of the door. A door control unit provides various signals to the prime mover and brake and receives various status and position annunciation signals as well as door open and door close commands. A mechanical lock is provided to positively lock the door thus providing redundancy of a locking operation. The utilization of the brake enables avoiding a preload of the movable locking member against the stationary locking member thus improving reliability of the lock mechanism operation. A manual release is provided to enable manual opening of the door in an emergency condition or for maintenance purposes. Compression of the sealing means maintains superior protection against environmental factors such as moisture, noise and dust as well as prevent component vibration due to tolerance and wear. Various annunciation means are incorporated to provide position and status feedback to the door control unit. Combination of the brake and lock mechanism eliminates any possibility for unintentional door opening due to a single component failure.

OBJECTS OF THE INVENTION

It is, therefore, one of the primary objects of the present invention to provide a lock arrangement for a door system of a transit vehicle which enables door seal compression.

Another object of the present invention is to provide a lock arrangement for a door system of a transit vehicle which enables door locking in a pushback and non-pushback condition.

Yet another object of the present invention is to provide a lock arrangement for a door system of a transit vehicle which enables door seal compression without affecting the reliability of the lock arrangement operation.

Another object of the present invention is to provide a lock arrangement for a door system of a transit vehicle which enables redundancy of maintaining the door in a closed and locked position.

Still another object of the present invention is to provide a lock arrangement for a door system of a transit vehicle which eliminates the vibration of the door system due to tolerances and component wear.

It is an additional object of the present invention to provide a lock arrangement for a door system of a transit vehicle which maintains the door in the closed position after the activation of the interior emergency release until the transit vehicle reaches a predetermined speed.

In addition to the various objects and advantages of the present invention which have been generally described above, there will be various other objects and advantages of the invention that will become more readily apparent to those persons who are skilled in the relevant art from the following more detailed description of the invention, particularly, when the detailed description is taken in conjunction with the attached drawing figures and with the appended claims.

Figure 1:
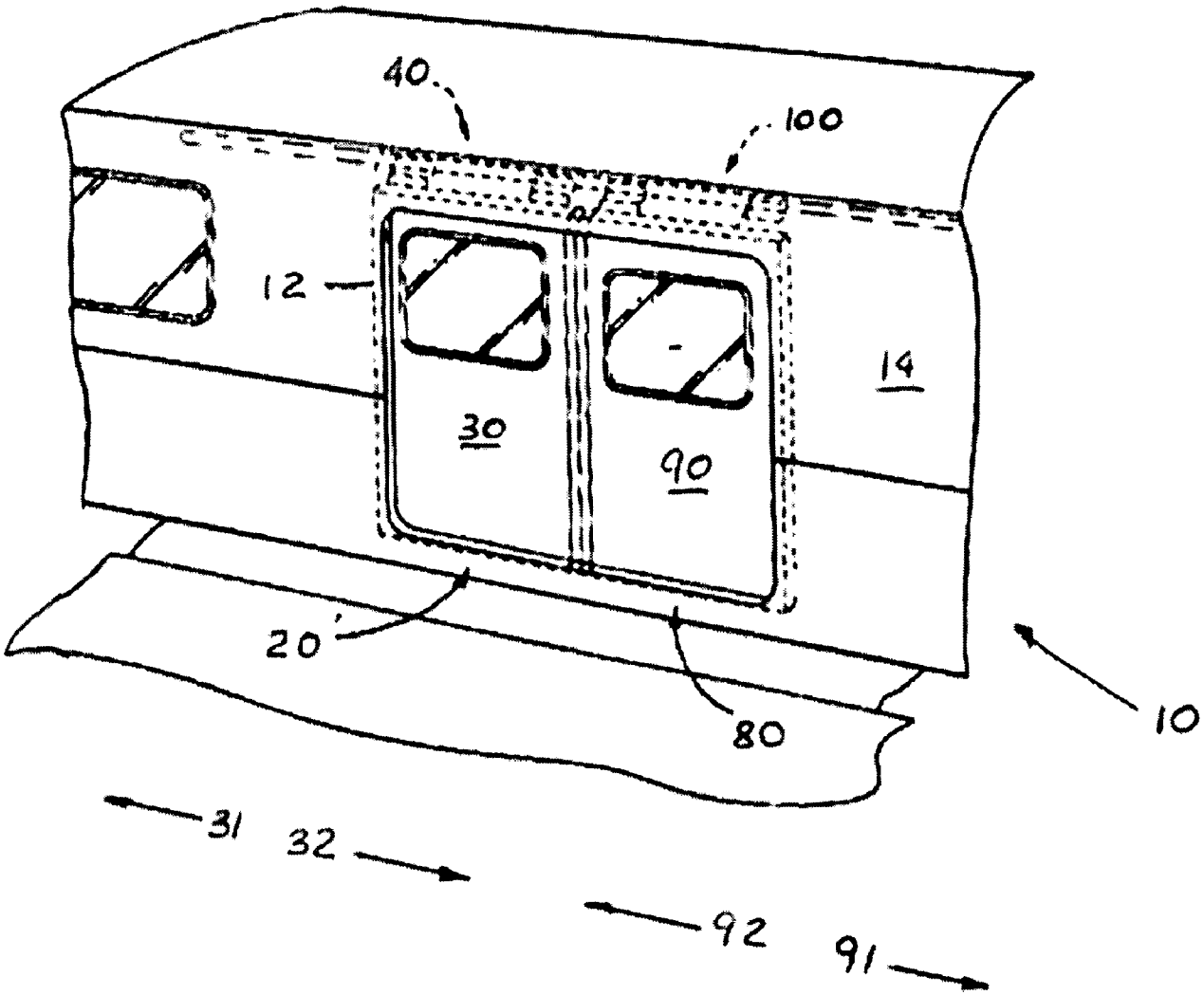
FIG. 1 is a partial perspective view of a typical transit vehicle door system.

DESCRIPTION OF THE PRESENTLY PREFERRED AND VARIOUS ALTERNATIVE EMBODIMENTS OF THE INVENTION

Before describing the invention in detail, the reader is advised that, for the sake of clarity and understanding, identical components having identical functions have been marked where possible with the same reference numerals in each of the Figures provided in this document.

The following description will be concerned with a door system for a transit vehicle since those skilled in the art will appreciate its features and adaptations to other vehicle types.

In reference to FIG. 1, there is shown a first transit vehicle door system, generally designated 20, for at least partially covering and uncovering a door portal aperture 12 for ingress and egress of passengers in a wall 14 of a transit vehicle 10. The first door system 20 may be selected from a group of a sliding, pocket sliding, swing, or swing/sliding combination types.

The first door system 20 has a first door 30 mounted for movement in a first door closing direction 32 to a first door closed position at least partially covering the door portal aperture 12 and for movement in a first door opening direction 31 to a first door open position at least partially uncovering the door portal aperture 12. The first door opening direction 31 being opposite to the first door closing direction 32.

Such first door system 20 further has a door drive means, generally indicated 40, connected to the first door 30 for moving the first door 30 to a first door closed position and for moving the first door 30 to a first door open position.

A second door system, generally designated 80, is disposed adjacent the first door system 20 in the portal opening 12. The second door system 80 has a second door 90 for longitudinal movement opposite to the first door 30, the second door 90 moving in a second door closing direction 92 to a second door closed position at least partially covering aperture 12 when first door 30 moves in the first door closing direction 32, and second door 90 moving in a second door opening direction 91 to a second door open position at least partially uncovering aperture 12 when first door 30 moves in the first door opening direction 31. The second door closing direction 92 is generally opposite to the first door closing direction 32 and the second door opening direction 91 is generally opposite to the first door opening direction 31. Hence, the first door 30 and the second door 90 cooperate to cover and uncover the aperture 12. Such second door system 80 further has a door drive, generally indicated 100, connected to second door 90 for moving the second door 90 to a second door closed position and for moving the second door 90 to a second door open position.

The first door system 20 and the second door system 80 are essentially mirror images of each other. Therefore, only the first door system 20 is described hereinafter. Furthermore, the description will be provided for a sliding or pocket sliding door system type as adaptations for a swing and swing/sliding combination door type will be obvious to those skilled in the relevant art form.

Figure 2:
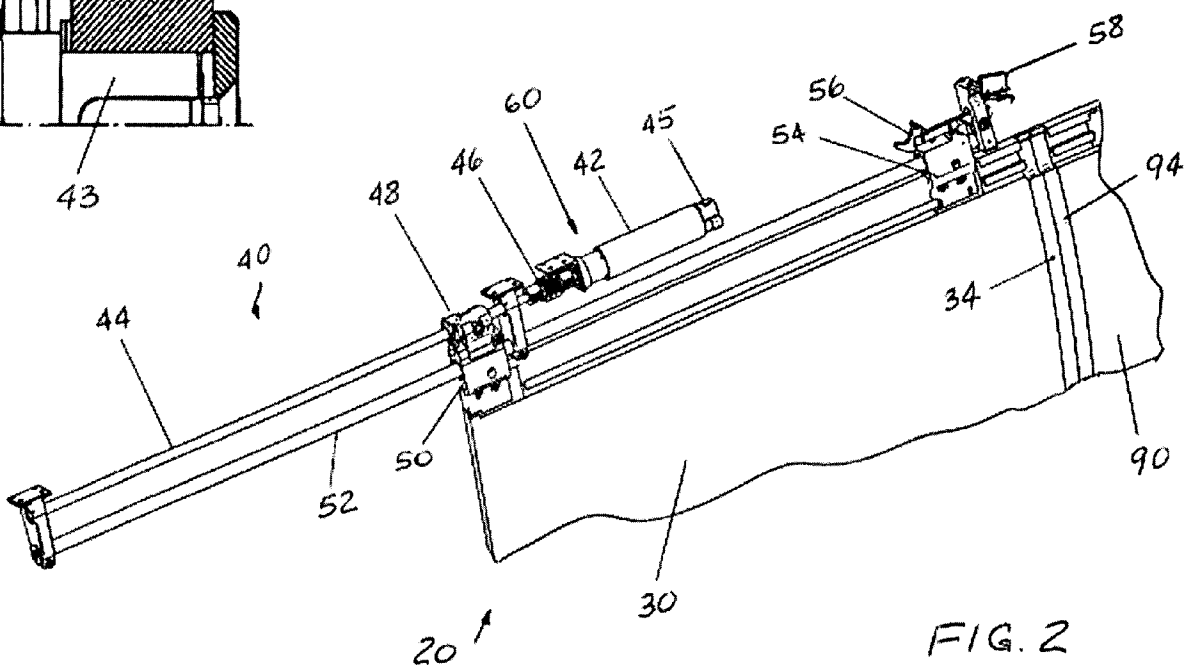
FIG. 2 is a partial perspective view of the door system, particularly showing a powered door drive means and door.
Figure 4:
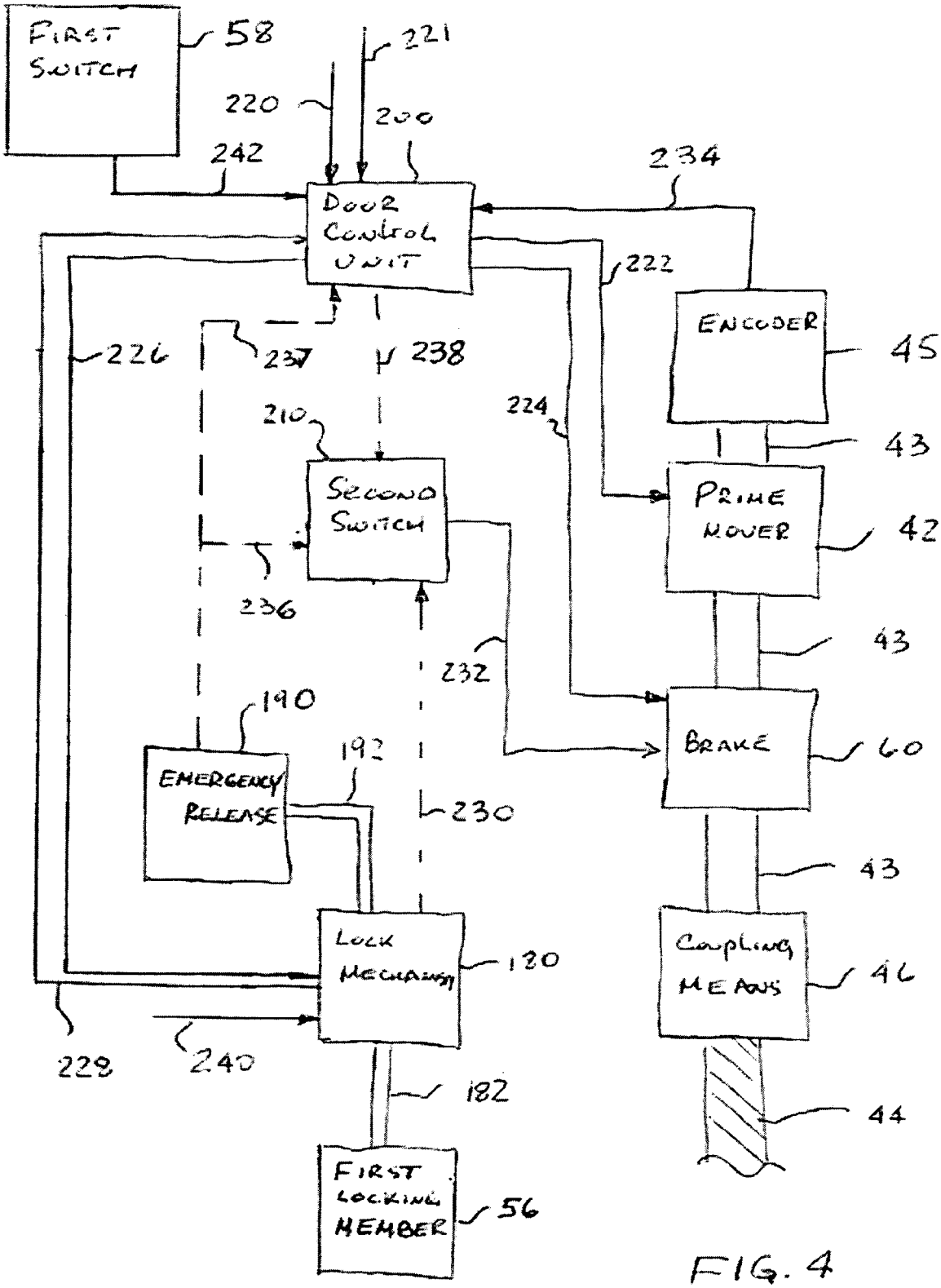
FIG. 4 is a schematic illustration which shows an embodiment of the invention connected to the door system control unit.
Figure 5:
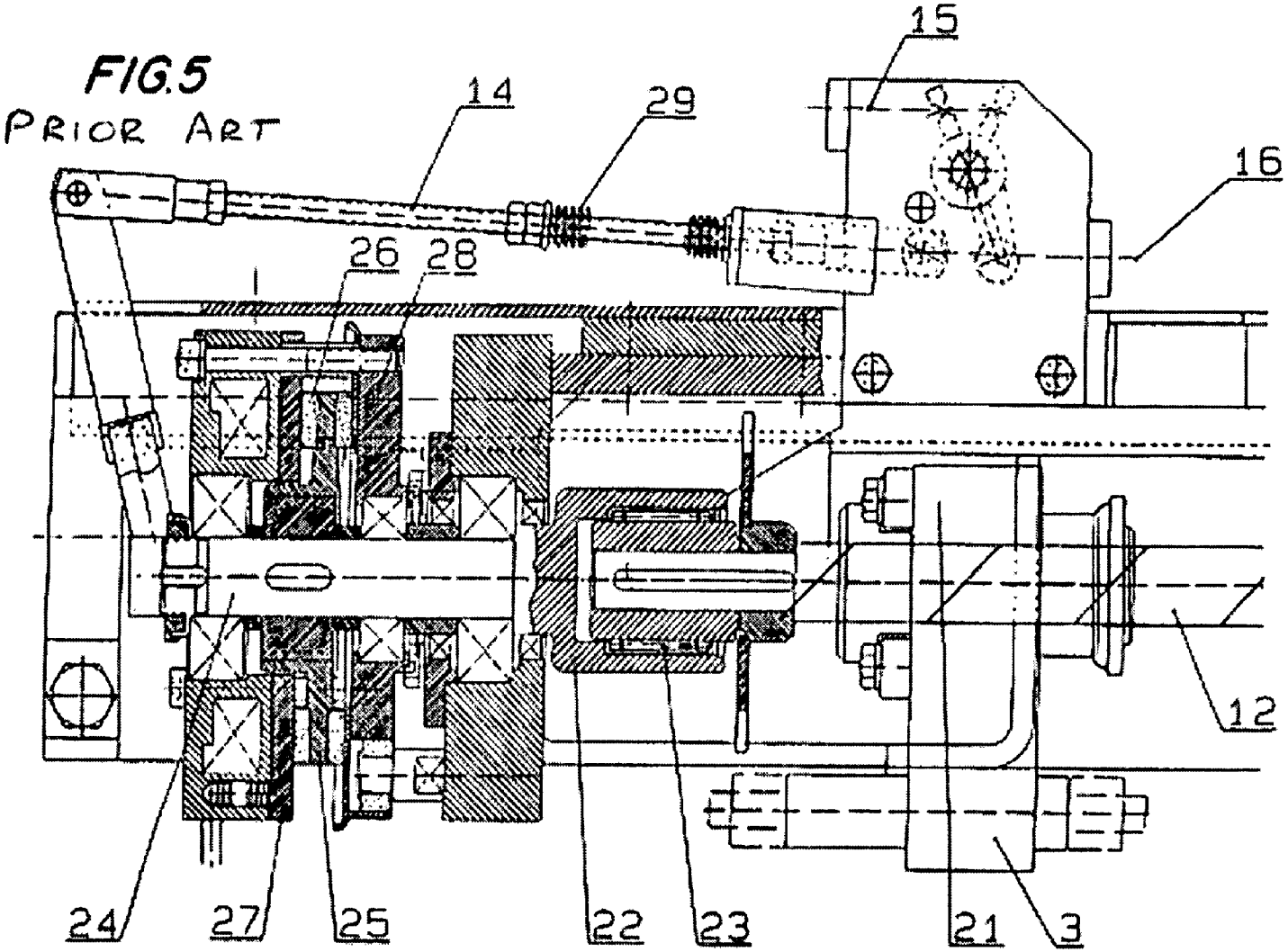
FIG.5 PRIOR ART
FIG. 5 is a partial cross-sectional elevation view of the prior art design.

As illustrated in FIGS. 2 and 4, the first door drive means 40 includes a prime mover 42 rotatably connected to a drive spindle 44 with a coupling means 46 at one end of first door drive means 40. The prime mover 42 may be of a pneumatic or hydraulic type, but preferably is an electric motor. An encoder 45 is connected to the prime mover 42 and provides at least one output position feedback signal 234 to a door control unit 200.

A drive nut 48 engages such drive spindle 44 to be substantially linearly driven thereby upon rotation of such drive spindle 44 enabled by prime mover 40. Additionally, drive nut 48 engages a first door hanger bracket 50 coupled with a drive guide member 52 and substantially connected to the first door 30, for carrying such first door 30 in the door portal aperture 12. The drive guide member 50 is disposed substantially parallel to the drive spindle 44.

The first door hanger bracket 50 provides rotational constraint in order to prevent drive nut 48 from rotating about an axis of drive spindle 42. First door hanger bracket 50 further provides linear constraint of such drive nut 48 along the longitudinal axis of drive spindle 42 so that rotation of drive spindle 42 causes motion of drive nut 48 parallel to the longitudinal axis of drive spindle 42 and further causes the movement of the first door 30 in the directions 32 and 31 to at least partially cover and uncover the door portal opening 12.

The first door drive means 40 further includes a second door hanger bracket 54 coupled to the drive guide member 52 and connected to the first door 30. Second door hanger bracket 54 may be fitted with a first locking member 56 adapted for engagement with a second locking member 182 disposed within lock mechanism 180 which is stationaryly mounted within such first door system 20.

Alternatively, first locking member 56 may be attached directly to first door 30. It will be understood that second door hanger bracket 54 may be integral with such first door hanger bracket 50 to form a single door hanger bracket for carrying the first door 30.

Lock mechanism 180 may be adapted to provide a first annunciation signal 228 to the door control unit 200 indicating the engagement of such first locking member 56 with the second locking member 182. The lock mechanism 180 may be further adapted to directly receive at least one zero speed signal 240 originated within the propulsion system (not shown) of the transit vehicle 10.

At least one first switch 58 of a predetermined type provides a second annunciation signal 242 to the door control unit 200 of the first door system 20 indicating engagement with either first or second hanger brackets 50 and 54 respectively or directly with the first door 30. Additionally, the at least one first switch 58 may indicate engagement of the first locking member 56 with the second locking member 182 in applications using such lock mechanism 180 and such first locking member 56.

Figure 3:
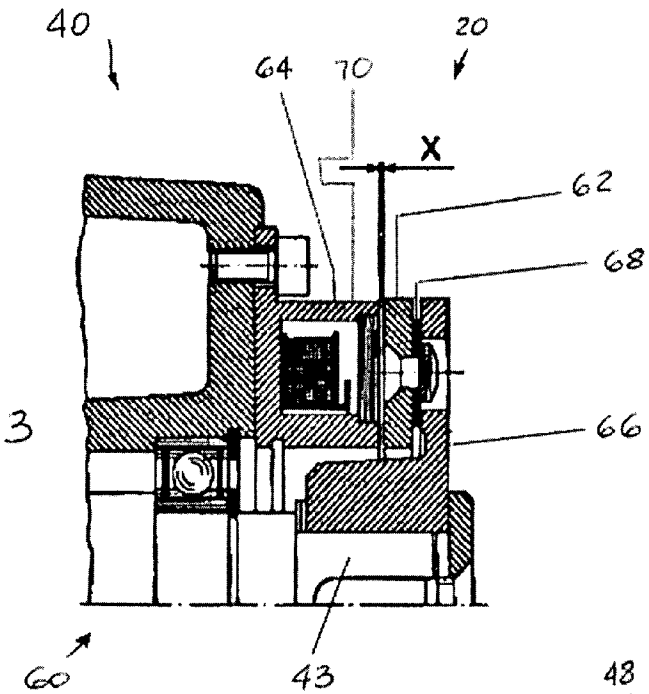
FIG. 3 is a partial cross-sectional plan view of the electromagnetic brake.

A typical electromagnetic brake, generally designated 60, is illustrated in FIG. 3. The electromagnetic brake 60 is provided for locking the first door 30 and further for maintaining required sealing engagement and compression between the first door 30 and the second door 90. Preferably it is integral to the electric motor 42 and is stationaryly coupled to the motor shaft 43. Alternatively the electromagnetic brake 60 may be attached directly to the drive spindle 44 intermediate coupling means 46 and the drive spindle 44 end which is adjacent coupling means 46, particularly in applications utilizing a pneumatic or hydraulic prime mover 42.

The electromagnetic brake 60 contains an armature 62, a brake magnet 64 which is stationaryly disposed at a predetermined gap X from the armature 62, a hub 66 stationaryly coupled to the motor shaft 43 and further coupled to the armature 62, and at least one spring 68 which is attached to both armature 62 and hub 66. A wiring connection 70 receives a first brake signal 234 from the door control unit 200 and receives a second brake signal 232 from the second switch 210 disposed within the first door system 20.

As further illustrated in FIG. 2, the first door 30 includes a first sealing means 34 which is attached by any well known means to a leading edge of the first door 30. Such first sealing means 34 engages a second sealing means 94 which is attached to the second door 90 to substantially seal the door portal aperture 12 at a vertical center plane thereof.

Those skilled in the art will readily understand that such second sealing means 94 may be attached directly to the edge of the door portal opening 12 where only the first door 30 is disposed therein.

To close and lock the first door 30, the door control unit 200 receives a door close signal 220 from the transit vehicle control system (not shown) and provides a prime signal 222 which energizes electric motor 42 thus enabling rotation of the drive spindle 44 and subsequent longitudinal motion of the first door 30 in the first closing direction 32.

In applications where only the electromagnetic brake 60 is used for locking purposes, such first door 30 is generally driven to its first locked position wherein the first sealing means 34 and the second sealing means 94 are compressed by the force from the electric motor 42. Such first locked position is generally known as substantially closed and locked position. At this point, the door control unit 200 provides a brake signal 224 to energize the electromagnetic brake 60 and then discontinues the prime signal 222 to deenergize the electric motor 42. The least one first switch 58 is activated providing a second annunciation signal 242 to the door control unit 200, indicating that such first door 30 is closed and locked.

In the non-pushback mode, when the first locking member 56 engages the second locking member 182 of the lock mechanism 180 and is restrained thereby from moving back toward the opening direction 31, the first door 30 is in a second locked position, which is maintained at a first predetermined distance, which is typically about 5 mm from the first locking position being a substantially closed and locked position. Once the transit vehicle 10 is ready to depart from the station, the first door 30 is further driven to its first locked position wherein the first sealing means 34 and the second sealing means 94 are compressed by force from the electric motor 42. However, the first locked member 56 is maintained at such first predetermined distance from substantial contact with the second locking member 182.

At this point, the door control unit 200 provides a brake signal 224 to energize the electromagnetic brake 60 and then discontinues the prime signal 222 to deenergize electric motor 42. The lock mechanism 180 provides a first annunciation signal to the control unit 200 and the at least one first switch 58 is activated providing a second annunciation signal 242 to the door control unit 200. Lock mechanism 180 and the at least one first switch 58 thus independently indicate that such first door 30 is closed and locked.

In the pushback mode, the second locking member 182 is further fitted with the third locked position, which is at a second predetermined distance, typically of about 60 mm, from such first locked position. At his point the first door 30 cannot be reopened because of positive engagement of the first locking member 56 with the second locking member 182. However, the first door 30 is enabled for manual movement toward the opening direction 31 between such second and such third locked positions so that a riding patron can withdraw an object, a body part or a garment captured between the first sealing means 34 and the second sealing means 94.

As further related to the pushback mode, once the transit vehicle 10 is ready to depart from the station, the first door 30 is powered for additional movement to the first locked position, which is a substantially closed and locked position, wherein the first sealing means 34 and the second sealing means 94 are compressed by the force from the electric motor 42. At this point, the door control unit 200 provides a brake signal 224 to energize the electromagnetic brake 60 and then discontinues the prime signal 222 to deenergize the electric motor 42. The lock mechanism 180 provides a first annunciation signal to the control unit 200 and the at least one first switch 58 is activated providing a second annunciation signal 242 to the door control unit 200. Such lock mechanism 180 and the at least one first switch 58 thus independently indicate that such first door 30 is closed and locked.

Internal to the electromagnetic brake 60, the armature 62 is attracted by the force of the magnetic field over the predetermined air gap X to the brake magnet 64 resulting in a frictionally engaged connection. This frictionally engaged connection prevents rotation of the hub 66 which is stationaryly coupled to the motor shaft 43 and further coupled to armature 62 and, more particularly, prevents rotation of the motor shaft 43. The first door 30 thus remains tightly sealed against either the second door 90 or the edge of the door portal aperture 12.

To open the first door 30 in normal operation, door control unit 200 receives a door open signal 221 from the transit vehicle control system (not shown) and provides an unlock signal 226 which energizes the unlock mover 184 (not shown) disposed within the lock mechanism 180 thus enabling disengagement of the second locking member 182 from the first locking member 56. Additionally the lock mechanism 180 may receive the at least one zero speed signal 240 indicating that the transit vehicle 10 is at a predetermined speed. Next, the door control unit 200 discontinues the output brake signal 224 to the electromagnetic brake 60. Internal to the electromagnetic brake 60, the magnetic field over the gap X is removed causing frictional disengagement between the armature 62 with the brake magnet 64 thus enabling rotation of the hub 66 and, more particularly, enabling rotation of the motor shaft 43. Finally, the door control unit 200 reactivates the prime signal 222 to the electric motor 42 enabling it to move the first door 30 toward the opening direction 31.

To manually open the first door 30 in an emergency condition or for maintenance purposes, a manual release mechanism 190 is generally provided within the transit vehicle 10.

When the first door system 20 employs only the electromagnetic brake 60 for locking purposes, the manual release mechanism 190 may simply provide an electrical signal 237 to the door control unit 200 or an electrical signal 236 to the at least one second switch 210 thus discontinuing the first brake signal 224 or providing a second brake signal 236 respectively to deenergize the electromagnetic brake 60.

When first door system 20 further employs lock mechanism 180, the manual release 190 is generally connected thereof via a cable or a lever 192 to disengage the second locking member 182 from the first locking member 56 and generally remove the first annunciation signal 228 to the door control unit 200 causing it to discontinue the first brake signal 224 and deenergize electromagnetic brake 60. With first locking member 56 disengaged and electromagnetic brake 60 deenergized, the door 30 is enabled to be manually moved toward the opening direction 31.

Alternatively, deenergization of the electromagnetic brake 60 may be achieved via the at least one second switch 210 and various signals 230, 232, 236, and 238, as best illustrated in FIG. 4. Such at least one second switch 210 may also be disposed within the lock mechanism 180.

Those skilled in the art would appreciate that desired pneumatic or hydraulic signals may be provided through the use of well-known electro/pneumatic or electro/hydraulic components where the prime mover 42 is of a respective type.

The at least one first switch 58 and the at least one second switch 210 may be of a proximity sensor type but are preferably of a solid state type having contacts of a predetermined current rating.

It can be easily seen that the electrical motor 42 applies a predetermined compression force onto the first sealing means 34 against the adjacent sealing means 94 and that the electromagnetic brake 60 maintains such predetermined compression force enabling substantial reduction of the exterior noise, moisture and dust from penetrating the interior of the transit vehicle 10. The application of the permanent force further overcomes mechanical tolerances and slack of the first door system 20 and, more importantly, it enables a substantially reduction in vibration and rattling of such first door system 20 during motion of such transit vehicle 10. It is understood that such predetermined compression force will be varied depending on specific requirements and design of the first sealing means 34 and the second sealing means 94 by varying the torque output of the electrical motor 42 prior to the electromagnetic brake 60 application.

Ability of the present invention to achieve and maintain compression of the adjacent sealing means without direct contact between the first locking member 56 and the locking member 182 substantially eliminates the need for frequent adjustments and fine tuning of the lock mechanism 180 during the life of the first door system 20. Such compression ability further enables compensation for assembly and component tolerances, deflection of the transit vehicle 10 structure, mechanical wear of the first door system 20, and flexibility of the first and second sealing means 34 and 94 respectively due to temperature and moisture fluctuations.

Additionally, such predetermined compression force enables simplification of the sealing means design and interface between adjacent sealing means and, more importantly, enables standardization of such sealing means. And finally, absence of external frictional forces acting on the first locking member 56 while the first door 30 is in the closed and locked position substantially reduces the force required to manually unlock such first door 30 in the emergency conditions.

The combination of the electromagnetic brake 60 and lock mechanism 180 enables redundancy of maintaining the first door 30 in the closed and locked position. As such, a failure of one of these components will not result in unintentional movement of the first door 30 in the opening direction 31. As best illustrated in FIGS. 2 and 4, the first annunciation signal 228 generated by the lock mechanism 180 and a second annunciation signal from the first switch 58 provide distinct annunciations of the first door 30 in the closed and locked conditions respectively. Failure of any of such first and second annunciation signals to be received by the door control unit 200 at a predetermined time will annunciate an unsafe condition of the first door 30 to the control system (not shown) of the transit vehicle 10.

In addition, electromagnetic brake 60 and electric motor 42 may be energized simultaneously at the beginning of the opening movement of the first door 30 to test for electromagnetic brake 60 operation. A failed electromagnetic brake 60 will enable the opening movement of first door 30 with encoder 45 providing at least one position feedback signal 234 to door control unit 200.

In applications where the lock mechanism 180 of the over center type is provided and the first door 30 can not be manually opened after actuation of the emergency release 190 unless the transit vehicle 10 reaches the predetermined speed, typically under about 3 miles per hour, such combination of the electromagnetic brake 60 and the lock mechanism 180 enables to maintain such first door 30 in the closed position after disengagement of the first locking member 56 from the lock mechanism 180.

While the presently preferred embodiment of the instant invention has been described in detail above in accordance with the patent statutes, it should be recognized that various other modifications and adaptations of the invention may be made by those persons who are skilled in the relevant art without departing from either the spirit of the invention or the scope of the appended claims.

We claim:

1. A door system in a transit vehicle for at least partially covering and uncovering a door portal aperture of said transit vehicle, said door portal aperture having a first sealing means attached to at least one edge thereof, said door system comprising:

(a) at least one door having a second sealing means disposed at a leading edge thereof;

(b) a door drive means disposed within said transit vehicle for moving said at least one door in an opening and a closing direction, said door drive means including:

(i) a rotatable drive spindle;

(ii) a prime mover connected to one end of said drive spindle with a coupling means, said prime mover enabling rotation of said drive spindle, said prime mover is adapted for receiving a prime signal, said prime mover enabling compression of said first sealing means with said second sealing means to establish a first locked position which is a substantially closed and locked position;

(iii) a drive nut engaging said drive spindle;

(iv) a drive guide member disposed substantially parallel to said drive spindle; and (v) at least one hanger bracket coupled to said drive guide means and to said at least one door, said at least one hanger bracket adapted for linear movement about said drive guide means; said at least one hanger bracket having a connection with said drive nut, said at least one hanger bracket enabling substantially linear movement of said drive nut upon rotation of said drive spindle in said closing and said opening directions, said at least one hanger bracket further enabling movement of said at least one door in said closing and said opening directions to at least partially cover and uncover said door portal aperture; and (c) a brake having a stationary magnet, an armature axially disposed at a predetermined air gap X from said stationary magnet and attracted thereto by a force of the magnetic field over said predetermined air gap X to said magnet resulting in a frictionally engaged connection, a hub directly attached to said armature and to one of said prime mover shaft and said drive spindle for rotation therewith, at least one spring disposed between said armature and said hub, and a wiring connection for receiving said at least one brake signal, said brake maintaining said at least one door in a first locked position and maintaining a compression of said first sealing with said second sealing means produced by said door drive means, said brake adapted for receiving at least one brake signal for an application and a release thereof.

2. A door system for a transit vehicle according to claim 1 wherein said door system further includes a door control unit disposed within said transit vehicle for providing said prime signal to said prime mover and said at least one brake signal to said brake, said door control unit further providing an unlock signal, said door control unit is adapted for receiving a door open signal and a door close signal and at least one position feedback signal and at least one annunciation signal.

3. A door system for a transit vehicle according to claim 2 wherein said door system further includes at least one first switch of a predetermined type disposed therein for one of providing a second annunciation signal to said door control unit indicating engagement with said at least one hanger bracket and indicating engagement of said first locking member with said second locking member, said second annunciation signal redundant to said first annunciation signal provided by said lock mechanism.

4. A door system for a transit vehicle according to claim 2 wherein said door system further includes a second switch of a predetermined type disposed within said transit vehicle for providing a second brake signal to deenergize said brake for enabling movement of said at least one door in said opening direction.

5. A door system for a transit vehicle according to claim 4, wherein said second switch is disposed within said lock mechanism.

6. A door system for a transit vehicle according to claim 1 wherein said door system further includes a redundant locking arrangement having:

(a) a first locking member engageable with one of said at least one hanger bracket and said at least one door;

(b) a stationary lock mechanism disposed within said transit vehicle, said stationary lock mechanism having a second locking member for engagement with said first locking member and an unlocking means for disengaging said second locking member from said first locking member to enable movement of said at least one door in said opening direction, said second locking member fitted with a second locked position.

7. A door system for a transit vehicle according to claim 6, wherein said stationary lock mechanism provides a first annunciation signal to said door control unit indicating an engagement of said first locking member with said second locking member, said stationary lock mechanism is adapted to directly receive at least one zero speed signal indicating a predetermined speed of said transit vehicle.

8. A door system for a transit vehicle according to claim 6, wherein said a stationary lock mechanism having a pushback means including said second locking member fitted with a third locked position enabling said at least one door to be manually and partially moved in said opening direction between said second locked position and said third locked position and further enabling a passenger to withdraw one of a garment, body part and an object captured by said first and said second sealing means.

9. A door system for a transit vehicle according to claim 1 wherein said door system further includes a manual release disposed within said transit vehicle for enabling manual unlocking of said at least one door by deenergizing said brake.

10. A door system for a transit vehicle according to claim 9 wherein said manual release is connected to said stationary locking mechanism with one of a cable and a lever, said manual release for disengaging said second locking member from said first locking member to enable movement of said at least one door in said opening direction.

11. A door system for a transit vehicle according to claim 1 wherein said prime mover is selected from the group consisting of electric mover, pneumatic mover, and hydraulic mover.

12. A door system for a transit vehicle, said door system comprising:

(a) a first door having a first sealing means;

(b) a second door having a second sealing means arranged complimentary to said first sealing means;

(c) a drive means connected to said first and said second door for moving said first and said second door for covering and uncovering a door portal aperture; and (d) a brake having a stationary magnet, an armature axially disposed at a predetermined air gap X from said stationary magnet and attracted thereto by a force of the magnetic field over said predetermined air gap X to said magnet resulting in a frictionally engaged connection, a hub directly attached to said armature and to one of said prime mover shaft and said drive spindle for rotation therewith, at least one spring disposed between said armature and said hub, and a wiring connection for receiving said at least one brake signal, said brake maintaining said first and said second door in a first locked position and maintaining a compression of said first sealing means with said second sealing means, said compression produced by said door drive means, said brake adapted for receiving at least one brake signal for an application and a release thereof.

13. A door system for a transit vehicle according to claim 12 wherein said door system is selected from the group consisting of a sliding, pocket sliding, swing, and swing/sliding combination types.

14. A method for determining failure of a brake in a transit vehicle door system by a door control unit, said method comprising the steps of:

(a) maintaining a first brake signal to energize said brake and providing a prime signal to energize a prime mover at a beginning of movement of at least one door in an opening direction;

(b) monitoring at least one door position by receiving at least the position feedback signal from an encoder disposed within said door drive means; and (c) thereafter annunciating said failure of said brake upon detecting an at least one door position change indicating movement of said at least one door in an opening direction.

15. A compression locking arrangement for a door system disposed within a door portal aperture of a vehicle, said door system including at least one door having a sealing means and a door drive means having a prime mover with an output shaft connected to a drive spindle with a coupling means, said door drive means further having at least one door hanger attached to said at least one door, said at least one door hanger connected to a drive nut coupled to said drive spindle, said compression locking arrangement including a brake having a stationary magnet, an armature axially disposed at a predetermined air gap x from said stationary magnet and attracted thereto by a force of the magnetic field over said predetermined air gap X to said magnet resulting in a frictionally engaged connection, a hub directly attached to said armature and to one of said prime mover shaft and said drive spindle for rotation therewith, at least one spring disposed between said armature and said hub, and a wiring connection for receiving said at least one brake signal, said brake maintaining said at least one door in a first locked position and maintaining a compression of said sealing means produced by said door drive means, said brake adapted for receiving at least one brake signal for an application and a release thereof.

16. A compression locking arrangement according to claim 15 wherein said compression locking arrangement further includes a first locking member adapted for attachment to one of said door drive means and said at least one door and a stationary lock mechanism disposed within said vehicle, said lock mechanism having a second locking member for engagement with said first locking member, said lock mechanism further having an unlocking means for disengaging said second locking member from said first locking member to enable movement of said at least one door in an opening direction, said second locking member is fitted with a second locked position.

17. A compression locking arrangement according to claim 16 wherein said lock mechanism is adapted for locking said at least one door in said second locked position and in a third locked position, said second locked position is at a second predetermined distance from said third locked position, said at least one door is adapted for manual movement between said second and said third locked positions to enable a passenger to withdraw one of a garment, body part and an object.

18. A compression locking arrangement according to claim 15 wherein said compression locking arrangement further includes a manual release disposed within said vehicle, said manual release enabling release of said brake and disengagement of said second locking member from said first locking member.

* * * * *